US006969831B1

(12) United States Patent
Parker et al.

(10) Patent No.: US 6,969,831 B1
(45) Date of Patent: Nov. 29, 2005

(54) HEATING PAD ASSEMBLY

(75) Inventors: Kenneth R. Parker, Delray Beach, FL (US); Patricia A. Bassett, Boca Raton, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 10/915,162

(22) Filed: Aug. 9, 2004

(51) Int. Cl.[7] ..... H05B 3/34
(52) U.S. Cl. ..... 219/528; 219/527; 219/529; 219/212; 219/549
(58) Field of Search ..... 219/528, 529, 219/212, 549, 527

(56) References Cited

U.S. PATENT DOCUMENTS

| | | | | |
|---|---|---|---|---|
| 2,482,655 | A * | 9/1949 | Cone | 112/9 |
| 2,498,983 | A * | 2/1950 | Albora | 219/527 |
| 3,623,485 | A * | 11/1971 | Price | 607/112 |
| 4,736,088 | A * | 4/1988 | Bart | 219/211 |
| 5,111,810 | A | 5/1992 | Fortney | |
| 5,193,235 | A * | 3/1993 | Kircher | 5/413 R |
| 5,197,595 | A * | 3/1993 | Coultas | 206/0.6 |
| 5,436,429 | A * | 7/1995 | Cline | 219/202 |
| 6,488,149 | B1 | 12/2002 | Montagnino | |
| 2002/0133213 | A1 * | 9/2002 | Tippitt | 607/98 |

* cited by examiner

*Primary Examiner*—Robin O. Evans
*Assistant Examiner*—Vinod Patel
(74) *Attorney, Agent, or Firm*—Lawrence J. Shurupoff

(57) ABSTRACT

A substrate for a heating pad, blanket or throw includes one or more heating elements and one or more securing loops disposed at a securing end of the substrate. Each of the securing loops is of sufficient diameter to encircle and secure the substrate in a scrolled configuration.

2 Claims, 4 Drawing Sheets

HEATING PAD ASSEMBLY

BACKGROUND OF THE DISCLOSURE

1. Field of the Invention

This disclosure relates to an apparatus for storing heating pads or blankets in a scrolled configuration and that is integrated into the heating pad or blanket itself.

2. Description of the Related Art

It is known to store electric heating pads in a variety of containers. Generally, some sort of folding or rolling of the heating pad or blanket is necessary to fit a pad into the container. A problem that arises is that the process of folding a heating pad may cause kinks in the heating elements within the pad that eventually lead to breakage of the heating elements.

A convenient way around the kinking problems associated with folding heating pads is to provide storage systems that allow the rolling, rather than folding, of the heating pad such as is described in commonly assigned U.S. Pat. No. 6,488,149 B1, issued Dec. 3, 2002, to Montagnino, J., for an ELECTRIC HEATING PAD STORAGE CONTAINER, which discloses a plastic tube into which a rolled up heating pad may be inserted. Also disclosed is a sleeve bag with a drawstring into which the heating pad may be inserted prior to insertion into the rigid plastic tube.

Anyone who has ever rolled up a sheet of material for insertion into a carrying tube has found on occasion that they failed to roll it tight enough and it won't fit into the tube. The sheet must then be unrolled and then rerolled tighter to fit it into the tube. The same problem can arise with a rolled heating pad or blanket. Moreover, as the carrying tube is separate and apart from the heating pad or blanket itself, it is subject to misplacement or loss, leaving the consumer without a storage means.

BRIEF SUMMARY OF THE DISCLOSURE

Disclosed is a heating pad assembly having a substrate comprising one or more heating elements, one or more securing loops disposed at a securing end of the substrate, and wherein each of the securing loops is of sufficient diameter to encircle and secure the substrate in a rolled up or scrolled configuration.

In another aspect of the invention the heating elements are disposed predominantly parallel to the securing end of the substrate.

In another aspect of the invention the securing loops are formed of an elastic material.

In another aspect of the invention the securing loops include a pair of strips of material fastenable to one another to form a loop configuration.

In another aspect of the invention the strips have hook-and-loop fastening surfaces.

In another aspect of the invention the securing loops are color-coded.

Another aspect of the invention further includes one or more loop storage pockets.

Another aspect of the invention further includes a dead zone at a leading end of the substrate.

DETAILED DESCRIPTION OF THE PREFERRED EMBODIMENTS

For the purposes of this disclosure, the term heating "pad" will also be construed to mean heating "blankets."

Figure 1:
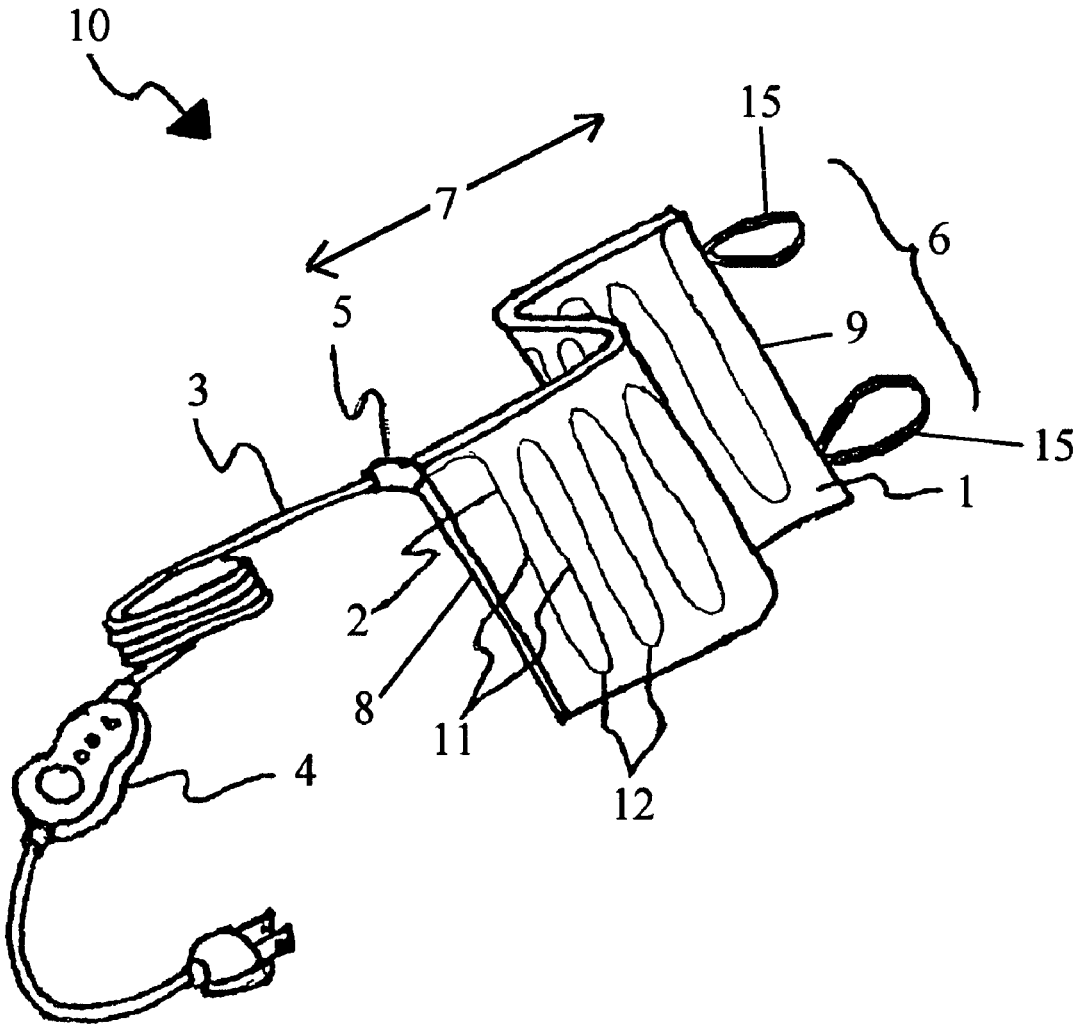
FIG. 1 is a perspective view of a typical heating pad or blanket provided with fastening loops in accordance with the invention.

Referring to FIG. 1, there is shown an embodiment of a heating pad 10 constructed in accordance with the invention. The heating pad 10 has a substrate 1 formed of a flexible material, such as a woven fabric, and one or more heating elements 2 disposed within the substrate 1. The substrate 1 may take the form of a pouch or sleeve which encloses and covers the heating elements. A power cord 3 is provided with a controller 4. The power cord 3 is attached to the heating pad 10 at a connection 5 so as to supply power to the heating elements 2.

The heating pad 10 may be described in terms of a width 6 and a longitudinal length 7 such that the heating pad 10 is designed to be rolled up along its length 7, by initiating the rolling of the pad from a leading end 8 to a securing end 9. The securing end 9 is provided with one or more securing loops 15 which are affixed to the substrate and therefore not subject to misplacement and loss. The securing loops 15 can be formed of an elastic material, but one may substitute for each securing loop a pair of strips fastenable together to form a loop, such as by providing on each strip a hook-and-loop type fastening surfaces, more commonly known by the trademark VELCRO. This alternative form of fastener 15 is shown schematically in dashed lines in FIG. 1.

It is desirable to minimize sharp bending of the heating element(s) 2 when rolling up the heating pad 10. Hence, it is desirable to have a heating element configuration wherein the heating elements are disposed predominantly parallel to the securing end of the substrate. One way to achieve this is to dispose the heating element(s) in a serpentine pattern having lengthy parallel sections 11 along the width 6 of the heating pad 10 connected by relatively short curved sections 12. Hence, during rolling, only the curved sections 12 are subject to mild bending and stress.

Figure 2:
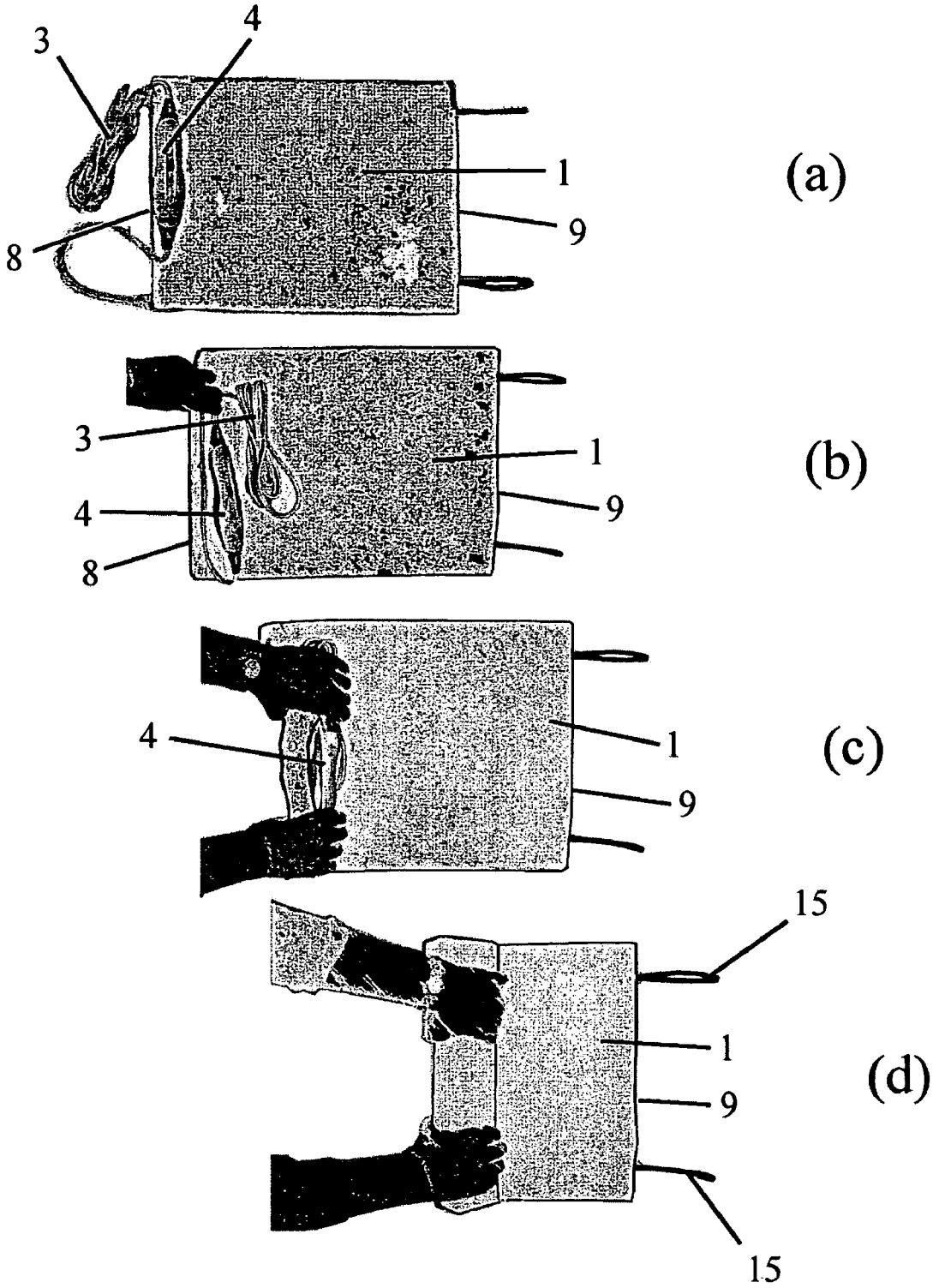
FIGS. 2*a* through 2*g* are perspective views of the consecutive steps in packing a heating pad of the invention.

Referring to FIGS. 2*a* through 2*g*, there is shown a method of rolling up the heating pad 10 into a rolled up configuration in accordance with the invention. As seen in FIGS. 2*a* and 2*b*, the user gathers the controller 4 and power cord 3 and places it upon the substrate 1 at the leading end 8 of the heating pad 10. The user then rolls the substrate over the power cord 3 and controller 4 starting at the leading end 8, rolling toward the securing end 9 as shown in FIGS. 2*c* and 2*d*.

Figure 2E:
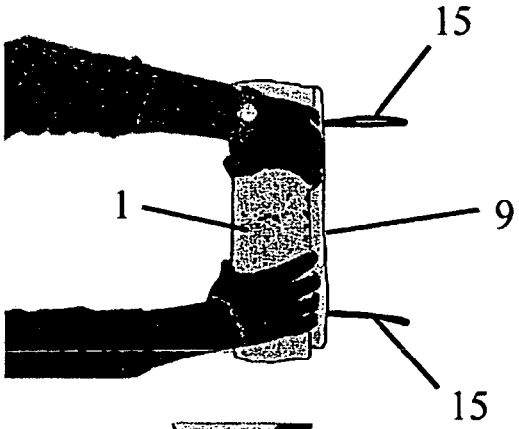
Figure 2F:
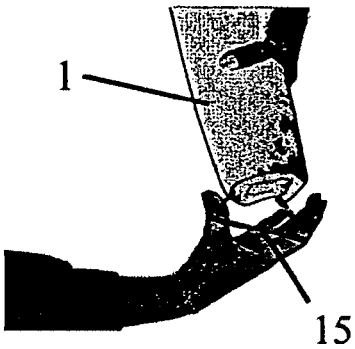
Figure 2G:
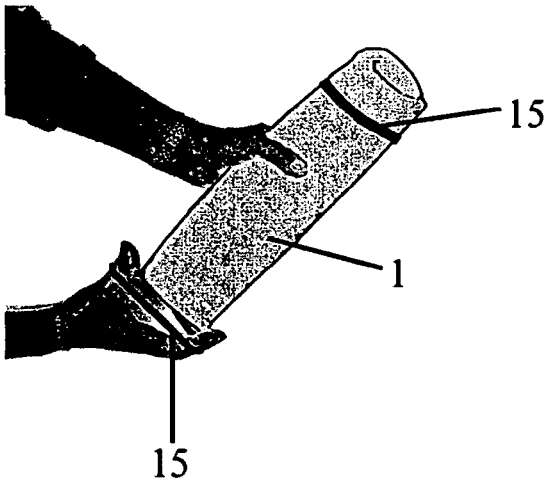
Figure 3:
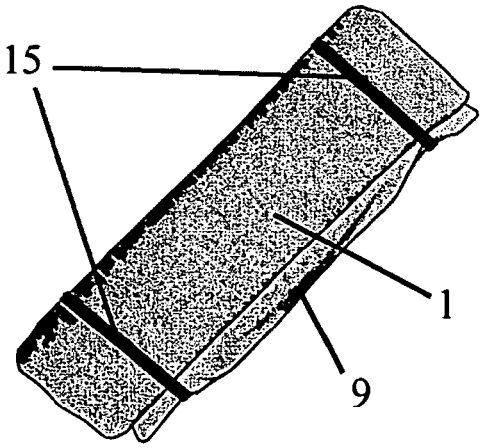
FIG. 3 is a perspective view of the invention in a rolled up configuration.

Referring to FIGS. 2*e* through 2*g*, the user rolls the substrate 1 up to the securing end 9 of the heating pad 10 and then wraps, encircles and applies the loops 15 around the substrate 1 to prevent it from unrolling. This leaves the entire assembly secured in the rolled up scrolled configuration shown in FIG. 3. As can be seen, unlike a sleeve container, it is irrelevant whether the substrate is rolled tightly or loosely. The securing loops 15 are elastic and will stretch to the diameter of the rolled up substrate and hold it firmly in its scrolled configuration.

Figure 4:
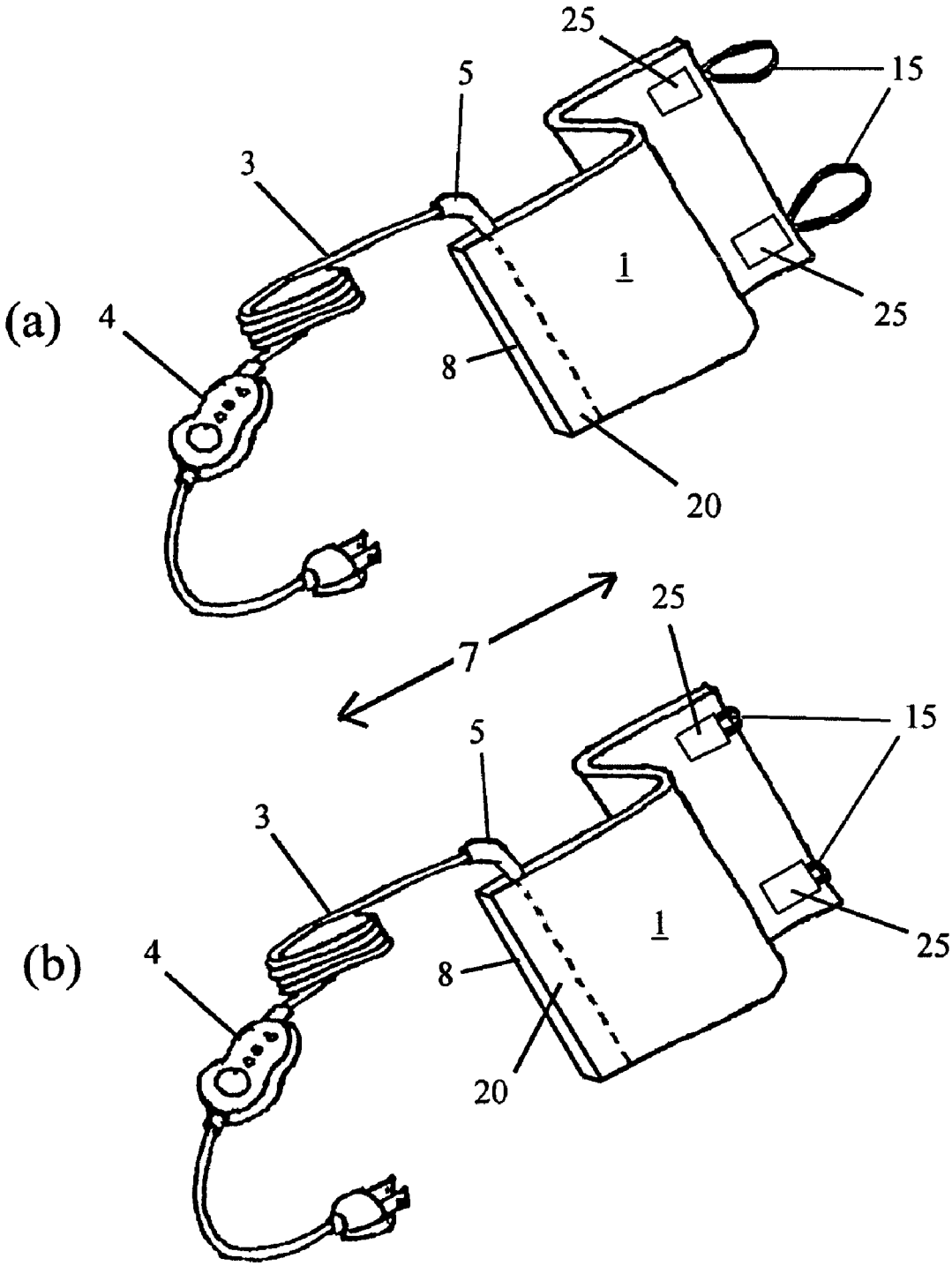
FIG. 4 is a perspective view of another embodiment of the invention.

Referring to FIGS. 4*a* and 4*b*, there is shown another embodiment of the invention having optional loop storage pockets 25 and/or an optional dead zone 20 which is free of heating elements 2. The purpose of the loop pockets 25 is to receive and store away the securing loops 15 when the heating pad 10 is in use, so as to prevent the loops 15 from being a bother to the user. FIG. 4*b* shows the securing loops 15 stored away in the loop storage pockets 25. Dangling securing loops 15 might otherwise be an annoyance in that they may catch onto objects about the house during heating pad use.

The dead zone 20 is a section of substrate 1 at the leading end 8 that has no heating elements 4 within it. This may be desirable in circumstances where the substrate 1 is so thin that the leading end 8 is very tightly coiled in the rolled up configuration, thereby putting maximum bend and stress on any wires that would otherwise be disposed within the leading end 8. The dead zone 20 will generally be chosen to add a length to the heating pad 10 effective in preventing damage to the heating elements 2, which added length will vary according to the thickness of the substrate. The thinner the substrate 1, the more dead zone 20 that will be preferred, but on average the dead zone 20 will add from one to three inches to the length 7 of the heating pad 10.

While various values, scalar and otherwise, may be disclosed herein, it is to be understood that these are not exact values, but rather to be interpreted as "about" such values, unless explicitly stated otherwise. Further, the use of a modifier such as "about" or "approximately" in this specification with respect to any value is not to imply that the absence of such a modifier with respect to another value indicated the latter to be exact.

Changes and modifications can be made by those skilled in the art to the embodiments as disclosed herein and such examples, illustrations, and theories are for explanatory purposes and are not intended to limit the scope of the claims. For example, belts, straps, cords and similar tethers can be permanently or removably attached to the heating pad 10 and having one or more end portions held securely looped around the scrolled heating pad with buckles, snap fasteners, sewing, and any other conventional fastening method. Further, the abstract of this disclosure is provided for the sole purpose of complying with the rules requiring an abstract so as to allow a searcher or other reader to quickly ascertain the subject matter of the disclosures contained herein and is submitted with the express understanding that it will not be used to interpret or to limit the scope or the meaning of the claims.

What is claimed is:

1. A heating pad adapted to be held in a scrolled configuration for storage, comprising:

a sleeve comprising a flexible cover material having a longitudinally extending length and a width, and a leading end and a securing end located at opposite ends of said longitudinally extending length;

a heating element disposed within said sleeve and having portions extending predominantly parallel to said securing end of said sleeve, said heating element spaced apart from said leading end to minimize bending of said heating element during scrolling;

an electrical connector coupled to said heating element;

a power cord coupled to said electrical connector for supplying power to said heating element;

a controller coupled to said power cord; and a closed elastic securing loop fixed on said pad adjacent to said securing end of said sleeve, such that said power cord and said controller are adapted to be placed on said leading end of said sleeve and scrolled-up within said sleeve to form a scrolled assembly, and said loop is adapted to elastically stretch around and encircle said scrolled assembly for storage and prevent said scrolled assembly from unrolling.

2. The heating pad of claim 1, wherein said heating pad is rolled up into said scrolled assembly and wherein said loop elastically encircles said scrolled assembly.

* * * * *